US005913340A

United States Patent [19]

McDonald

[11] Patent Number: 5,913,340

[45] Date of Patent: Jun. 22, 1999

[54] WALKWAY PLATFORM

[75] Inventor: Harley C. McDonald, Omaha, Nebr.

[73] Assignee: Composite Structures, Inc., Omaha, Nebr.

[21] Appl. No.: 08/929,861

[22] Filed: Sep. 15, 1997

[51] Int. Cl.[6] ..... E01D 1/00

[52] U.S. Cl. ..... 14/73; 14/69.5; 14/78; 108/51.11; 108/64; 108/901; 52/177; 52/302.1; 52/309.1; 52/630

[58] Field of Search ..... 108/51.11, 57.16, 108/57.25, 57.26, 57.28, 64, 901; 182/83, 222; 52/302.1–302.3, 177, 630, 650.3, 783.19, 789.1, 794.1, 309.1, 592.1; 14/73, 78, 73.1, 69.5, 2.4; 404/2, 4; 137/312, 362; 119/450, 527, 530

[56] References Cited

U.S. PATENT DOCUMENTS

D. 281,106 10/1985 Thomas et al. .
D. 306,100 2/1990 Wende .
D. 315,796 3/1991 Smith et al. .
4,103,857 8/1978 Levenhagen .
4,369,859 1/1983 Smits .
4,718,653 1/1988 Rothman .
5,054,580 10/1991 Cheek .
5,092,251 3/1992 Hamaker et al. .
5,343,814 9/1994 Pigott et al. .
5,351,627 10/1994 Junaedi .
5,375,537 12/1994 Gillispie et al. .
5,404,829 4/1995 Shuert .
5,408,937 4/1995 Knight, IV et al. .
5,411,113 5/1995 Lubinski .
5,417,167 5/1995 Sadr .

*Primary Examiner*—Robert Canfield
*Attorney, Agent, or Firm*—Zarley,McKee,Thomte, Voorhees & Sease; Dennis L. Thomte

[57] ABSTRACT

An elevated walkway platform comprising at least one elongated platform module positioned in a generally horizontal attitude and being supported above a work area. The platform module comprises a substantially flat deck having side walls or toe boards extending upwardly from the opposite sides thereof. A flange extends horizontally outwardly from the upper end of each of the toe boards. A plurality of transversely extending strengthening ribs are molded integrally with the module and are positioned beneath the deck for strengthening purposes. A pair of longitudinally extending strengthening ribs may also be provided at the underside of the deck at the opposite sides thereof. The strengthening ribs are filled with a rigid foam material. The module is also provided with handrail post supports positioned at the exterior surface of the toe boards and which are adapted to receive a handrail post therein. The entire module is constructed of a one-piece, molded plastic material reinforced with fiberglass. The configuration of the deck, toe boards, flanges, and the handrail posts of the handrail assembly inserted into the post supports causes the platform to act as a truss to further strengthen the entire structure.

14 Claims, 3 Drawing Sheets

WALKWAY PLATFORM

BACKGROUND OF THE INVENTION

1. Field of the Invention

This invention relates to a walkway platform and more particularly to a walkway platform for use in food processing plants or meat processing plants.

2. Description of the Related Art

Walkway platforms or catwalks are frequently utilized in food processing plants or meat processing plants and are supported above the floor by vertical posts, suspension cables or suspension posts to enable workers to walk between pieces of equipment in the plant. In food and meat processing plants, it is extremely important that the walkways be able to be completely cleaned and sanitized. The conventional metal walkways or catwalks often rust with constant cleaning and if the walkways are hosed down with a cleaning solution or the like, liquid from the cleaning operation drips onto the floor or equipment located below the catwalk. Further, the walkway platforms of the prior art are limited in length unless adequate supporting structure is provided. Additionally, the prior art walkway platforms do not have sufficient inherent strength or rigidity so as to be able to prevent bowing or buckling thereof.

SUMMARY OF THE INVENTION

An elongated walkway platform is described which includes one or more elongated platform modules positioned in a generally horizontal attitude and being supported above a work area. Each of the platform modules comprises a substantially flat deck having opposite sides and opposite ends. A pair of side walls or toe boards extend upwardly from the opposite sides of the deck and are integrally formed with the deck. Preferably, the deck and the toe boards are formed of a molded plastic material reinforced with glass fibers (fiberglass). The deck is provided with a plurality of spaced-apart transversely extending strengthening ribs at the bottom surface thereof which are filled with a substantially rigid foam material such as urethane or polyurethane to add strength to the platform. If required, a pair of longitudinally extending strengthening ribs may also be provided at the underside of the deck which are also filled with a substantially rigid foam material such as urethane or polyurethane. At least one of the platform modules is preferably provided with a drain opening formed in the deck thereof for connection to a drain pipe so that the cleaning water or cleaning solution on the deck between the toe boards may drain therefrom. The toe boards of the module are provided with a plurality of spaced-apart hand rail supports in the form of vertically disposed sockets for receiving handrails post supports or the like therein. Preferably, the upper surface of the deck has a non-slip pattern provided thereon. The entire assembly, with the exception of the foam material in the strengthening ribs is formed of a molded plastic material reinforced with fiberglass.

The configuration of the deck and toe boards forms a beam-like structure which not only provides a walkway platform complete with toe boards, as required by OSHA regulations, but it also serves as its own structural support member, allowing it to span longer distances between vertical supports. The structural integrity of the modules is further complemented by the addition of the handrail post supports at regular intervals along the sides of the module. When the handrail system is properly constructed and adhesively secured in the handrail post sockets, the resulting handrail and walkway deck structure act together as a truss to further strengthen the entire walkway structure, allowing it to span greater distances between vertical support members.

It is therefore a principal object of the invention to provide an improved walkway platform A further object of the invention is to provide a walkway platform which is comprised of a molded plastic material reinforced with fiberglass.

Still another object of the invention is to provide a walkway platform which prevents water or cleaning solution from dripping onto equipment located therebelow.

Still another object of the invention is to provide a walkway platform which will not rust.

Still another object of the invention is to provide a walkway platform which may include a plurality of platform modules joined together in an end-to-end relationship.

Still another object of the invention is to provide a walkway platform which has a configuration to form a beam-like structure to permit the platform to span greater distances without bending or buckling.

Still another object of the invention is to provide a walkway platform which has a plurality of integrally formed handrail post supports regularly spaced along the exterior surface of the toe boards so that when the handrail system is properly installed on the platform, the platform itself functions as a single unitary truss to permit the platform to span great distances without additional support.

Still another object of the invention is to provide a walkway platform which is durable in use, refined in appearance, and economical to manufacture.

These and other objects will be apparent to those skilled in the art.

DESCRIPTION OF THE PREFERRED EMBODIMENT

Figure 1:
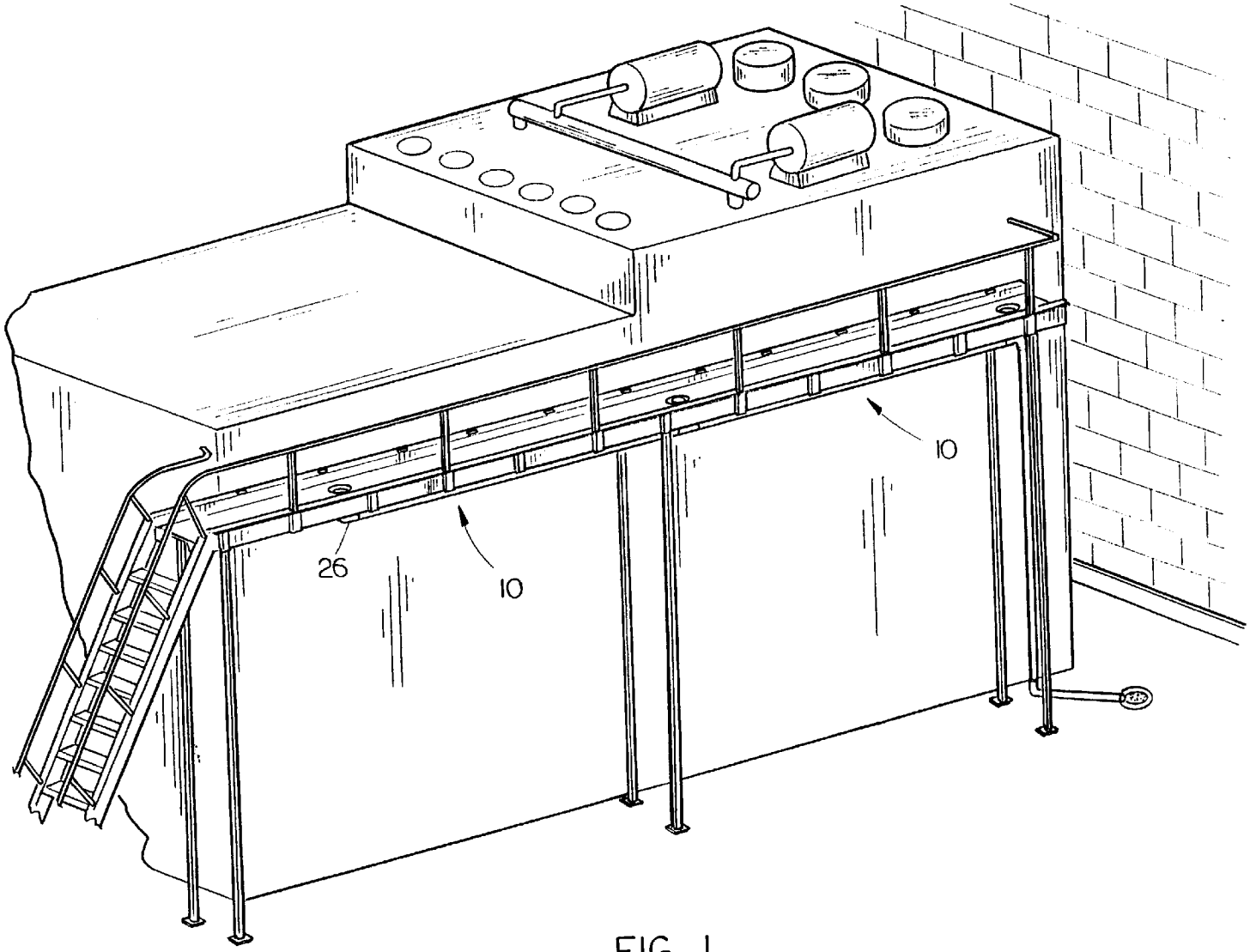
FIG. 1 is a perspective view of the walkway platform of this invention.
Figure 2:
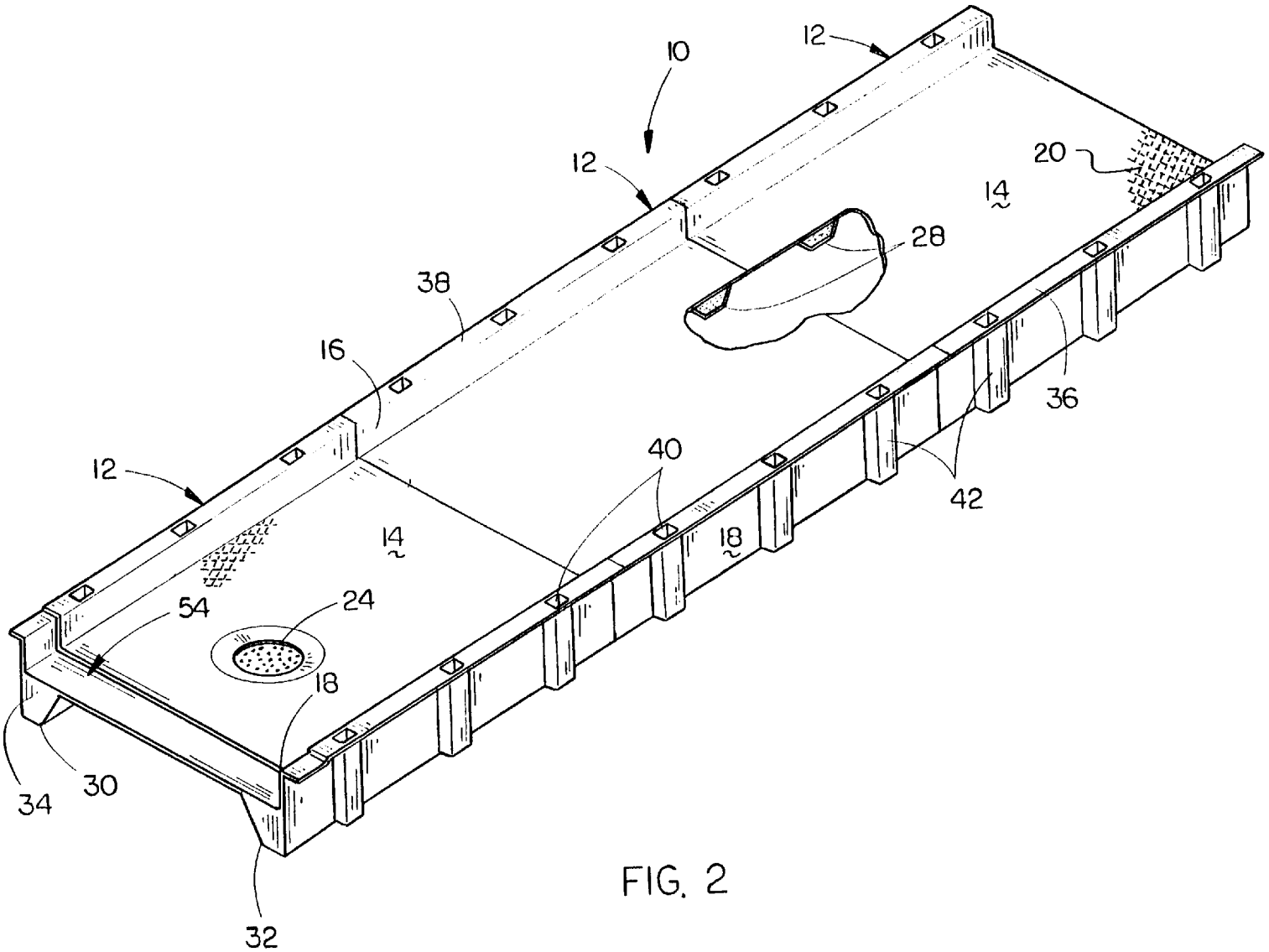
FIG. 2 is a perspective view of a form of the walkway platform with portions thereof cut away to more fully illustrate the invention.
Figure 3:
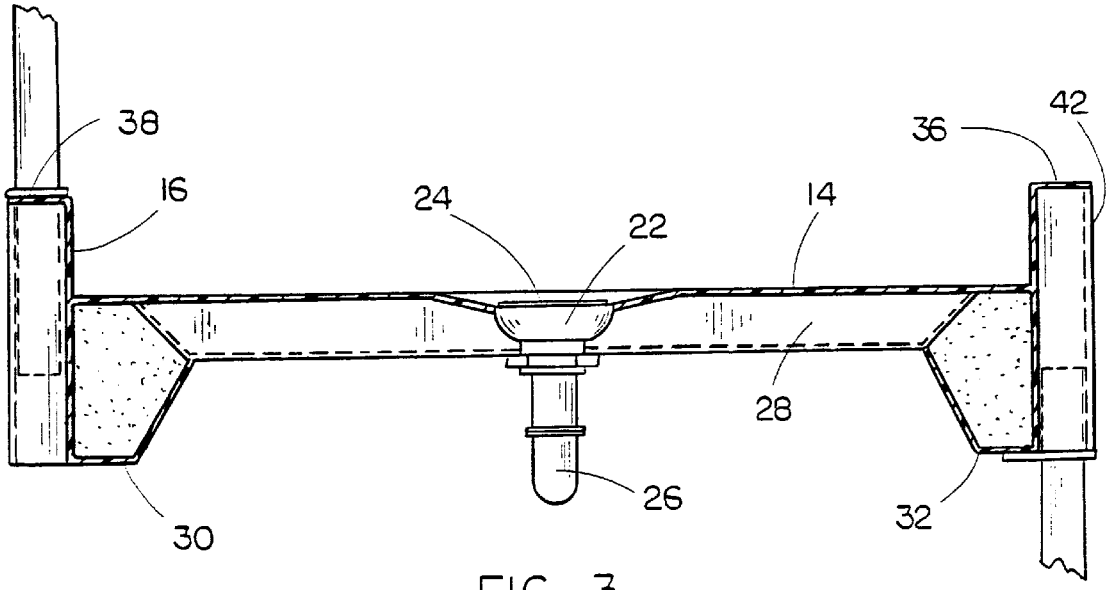
FIG. 3 is a transverse sectional view of the platform of FIG. 2.

The walkway platform of this invention is referred to generally by the reference numeral 10 and is comprised of one or more elongated platform modules 12 which may be connected in an end-to-end relationship to span the area over equipment or a floor surface in an elevated manner, as illustrated in FIG. 1. The platform 10 is designed to be either supported by cables or posts in conventional fashion. If a single module 12 is utilized, the module 12 is comprised of a substantially horizontally disposed deck 14 having vertically disposed side walls or toe boards 16 and 18 extending upwardly therefrom at opposite sides thereof. Preferably, toe boards 16 and 18 have integrally formed flanges 36 and 38 extending outwardly from the upper ends thereof, respectively. If only a single module is used, the ends of the module 12 will preferably also have upstanding end walls or toe boards to prevent water or cleaning solution from flowing from the otherwise open ends. If more than a single module 12 is employed, the ends of the platform are also preferably provided with end walls or toe boards. Deck 14 is also provided with a non-slip checker plate pattern referred to generally by the reference numeral 20. Module 12 is also preferably provided with a drain opening 22 formed in deck 14 which is covered with a perforated drain cap 24 to enable the cleaning water or cleaning solution to drain from the module 12 through the drain opening 22 which is connected to a drain pipe means 26.

Structural strength is added to the module 12 through the use of a plurality of strengthening ribs 28 integrally molded with the deck 14 which extend transversely with respect to the longitudinal axis of the module 12 in a spaced-apart relationship. The strengthening ribs 28 are hollow and are preferably filled with a rigid foam material such as urethane or polyurethane injected therein. If required, a pair of strengthening ribs 30 and 32 may also be integrally formed with the deck 14 and toe boards 16 and 18 which extend longitudinally along the length of the deck at the underside thereof adjacent the toe boards 18 and 20, respectively. Each of the ribs 30 and 32 are hollow and are preferably filled with a rigid foam material such as urethane or polyurethane.

If the walkway platform of this invention is to include side rails, which it normally will due to OSHA regulations, the flanges 36 and 38 will have openings 40 formed therein which communicate with handrail post supports or sockets 42 which are integrally molded with the module 12. Each of the supports or sockets 42 is adapted to receive a handrail post 44 therein which will be normally secured thereto by adhesive or the like. Handrail 45 is secured to and extends between the upper ends of the posts 44.

Figure 4:
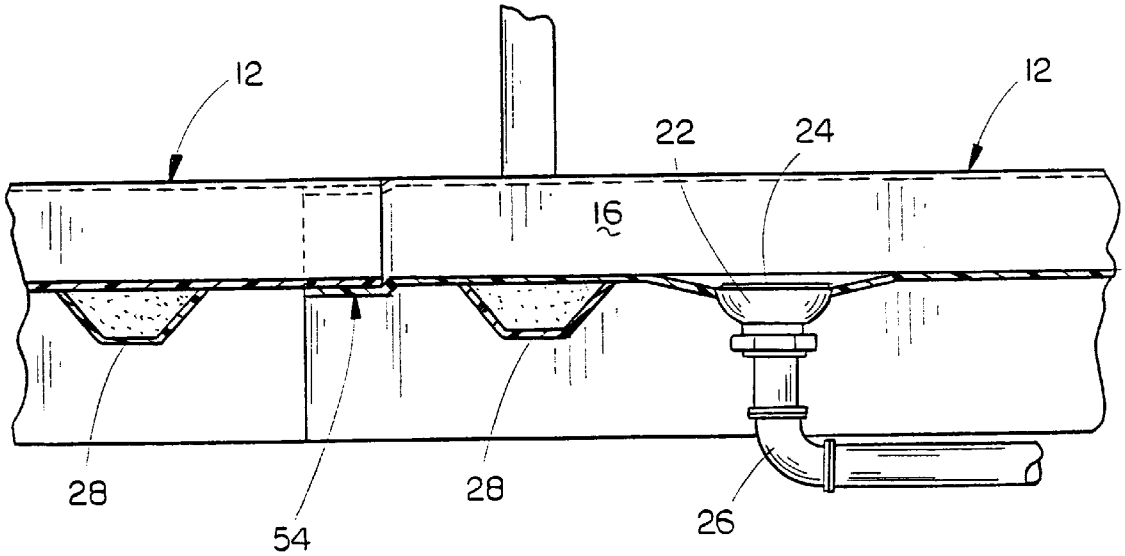
FIG. 4 is a longitudinal sectional view of the platform of FIG. 2.

If more than one platform module 12 is to be utilized in the walkway platform construction, one end of the module 12 is provided with a recessed receiver unit which is referred to generally by the reference numeral 54 while the other end of the module 12 will be provided with a structure adapted to overlap the receiver unit 54 such as illustrated in FIG. 4 to provide a watertight connection therebetween.

Preferably the walkway platform of this invention is comprised of a suitable molded plastic material reinforced with a fiberglass material and is of integral or unitary (one-piece) construction, as previously described. When the walkway platform of this invention is installed over a work area, the deck 14 and the inside surfaces of the toe boards 16 and 18 may be cleaned and/or sanitized with a liquid solution without fear that the solution will drip onto the equipment located below the walkway platform inasmuch as the water will collect on the upper surface of the deck 14 between the toe boards 16 and 18 and will pass therefrom through the drain opening 22 and drain pipe 26. The construction of the walkway platform prevents rust and will be extremely durable in use.

To summarize somewhat, each of the platform modules 12 comprises a substantially flat deck of greater length than width. The configuration of the flat deck, toe boards 16 and 18, and flanges 36 and 38 forms a beam-like structure with the flanges 36 and 38 acting as an upper beam, the toe boards 16 and 18 acting as a beam web, and the deck 14 acting as a lower beam. Therefore, not only does the invention serve as a walkway platform complete with toe boards, as required by OSHA regulations, but it also serves as its own structural support member, allowing it to span longer distances between vertical supports. The structural integrity of the invention is further complemented by the addition of the handrail post supports 42 at regular intervals of approximately four to five feet. The handrail post supports 42 serve as web and upper-flange stiffeners to give the "walkway beam" yet greater strength by helping to prevent web and upper flange buckling inasmuch as the handrail post supports 42 are integrally molded in a single unitary molding operation. The handrail post supports 42 form sockets, as previously stated, at regular intervals into which the handrail posts may be inserted for the support of the walkway handrail 45. The vertical support members may be either floor post or vertical suspension members. The handrail posts, floor posts or ceiling suspension members may be bolted in the sockets 42 or secured with adhesive such as an epoxy adhesive. When the handrail system is properly constructed and secured in the handrail post sockets 44, the resulting handrail and walkway deck structure act together as a truss to further strengthen the entire walkway structure, allowing it to span greater distances between vertical support members. While it has been described that glass fibers or fiberglass is used, carbon fibers could also be used.

Thus it can be seen that the invention accomplishes at least all of its stated objectives.

I claim:

1. An elevated walkway platform comprising:

at least one elongated platform module positioned in a generally horizontal attitude and being supported above a work area;

each of said platform modules comprising a substantially flat deck having opposite sides and opposite ends, said platform module having side walls extending upwardly from the opposite sides of said deck;

said deck and said side walls being of one-piece construction;

said deck and said side walls being comprised of a molded plastic material reinforced with fibers;

said side walls having spaced-apart handrail post supports provided thereon;

said handrail post supports being integrally formed with said side walls to provide a unitary member.

2. The walkway platform of claim 1 wherein said fibers are carbon fibers.

3. The walkway platform of claim 1 wherein said fibers are glass fibers.

4. The walkway platform of claim 1 wherein said deck is provided with at least one drain opening formed therein for connection to a drain pipe means.

5. The walkway platform of claim 1 wherein said deck has upper and lower surfaces and wherein said deck has a plurality of transversely extending strengthening ribs integrally formed with said deck and being positioned on said lower surface of said deck.

6. The walkway platform of claim 1 wherein said handrail post supports comprise vertically disposed sockets for receiving a handrail post therein.

7. The walkway platform of claim 1 wherein said handrail post supports comprise vertically disposed sockets, and wherein a vertically disposed handrail post is mounted in each of said sockets and is secured thereto and wherein a handrail is secured to the upper ends of said handrail posts.

8. The walkway platform of claim 1 wherein each of said side walls has an integrally formed flange extending horizontally outwardly from the upper end thereof; said flange and said side walls having handrail post supports integrally formed therein.

9. The walkway platform of claim 8 wherein a handrail post is secured to each of said post supports and wherein a handrail is secured to each of said posts.

10. An elevated walkway platform comprising:

at least one elongated platform module positioned in a generally horizontal attitude and being supported above a work area;

each of said modules comprising a substantially flat deck having opposite sides and opposite ends, said platform module having side walls extending upwardly from the opposite sides of said deck;

said deck and said side walls being of one-piece construction;

said deck and said side walls being comprised of a molded plastic material reinforced with fibers;

said fibers being glass fibers;

said deck having upper and lower surfaces;

said deck having a plurality of transversely extending strengthening ribs integrally formed with said deck and being positioned on said lower surface of said deck;

and a pair of longitudinally extending strengthening ribs integrally formed with said deck which are positioned at said lower surface of said deck.

11. The walkway platform of claim 10 wherein each of said strengthening ribs has an internal cavity which is filled with a substantially rigid foam material.

12. The walkway platform of claim 10 wherein said side walls have spaced-apart handrail post supports provided thereon; said handrail post supports being integrally formed with said side walls to provide a unitary member.

13. An elevated walkway platform comprising:

a plurality of platform modules secured together in an end-to-end relationship positioned in a generally horizontal attitude and being supported above a work area;

each of said platform modules comprising a substantially flat deck having opposite sides and opposite ends, said platform module having side walls extending upwardly from the opposite sides of said deck;

said deck and said side walls being of one-piece construction;

the ends of said modules having connection means provided thereon to enable said modules to be jointed together in a watertight end-to-end relationship.

14. An elevated walkway platform comprising:

a plurality of platform modules secured together in an end-to-end relationship positioned in a generally horizontal attitude and being supported above a work area;

each of said platform modules comprising a substantially flat deck having opposite sides and opposite ends, said platform module having side walls extending upwardly from the opposite sides of said deck;

said deck and said side walls being of one-piece construction;

at least one of said platform modules being provided with a drain opening formed therein for connection to a drain pipe means.

* * * * *